US008529829B2

(12) United States Patent
Satou et al.

(10) Patent No.: US 8,529,829 B2
(45) Date of Patent: Sep. 10, 2013

(54) HIGH-STRENGTH HOT-ROLLED STEEL SHEET WITH EXCELLENT COMBINED FORMABILITY

(75) Inventors: Motoo Satou, Kakogawa (JP); Tetsuo Soshiroda, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 879 days.

(21) Appl. No.: 12/294,341

(22) PCT Filed: Mar. 14, 2007

(86) PCT No.: PCT/JP2007/055050

§ 371 (c)(1),
(2), (4) Date: Sep. 24, 2008

(87) PCT Pub. No.: WO2007/122910

PCT Pub. Date: Nov. 1, 2007

(65) Prior Publication Data

US 2009/0136378 A1 May 28, 2009

(30) Foreign Application Priority Data

Mar. 24, 2006 (JP) ..... 2006-082968

(51) Int. Cl.
*C22C 38/16* (2006.01)
*C22C 38/00* (2006.01)
*C22C 38/08* (2006.01)

(52) U.S. Cl.
USPC ..... 420/92; 420/93; 148/332; 148/336

(58) Field of Classification Search
None
See application file for complete search history.

(56) References Cited

U.S. PATENT DOCUMENTS

| | | | | |
|---|---|---|---|---|
| 6,280,538 | B1 | 8/2001 | Soshiroda et al. | |
| 6,319,338 | B1 * | 11/2001 | Kawano et al. | 148/328 |
| 2005/0155673 | A1 | 7/2005 | Soshiroda et al. | |

FOREIGN PATENT DOCUMENTS

| | | | |
|---|---|---|---|
| EP | 0997548 | * | 3/2000 |
| JP | 6 172924 | | 6/1994 |
| JP | 11 80890 | | 3/1999 |
| JP | 2000 290745 | | 10/2000 |
| JP | 2001 200339 | | 7/2001 |

(Continued)

OTHER PUBLICATIONS

U.S. Appl. No. 11/908,423, filed Sep. 12, 2007, Satou, et al.
U.S. Appl. No. 13/210,807, filed Aug. 16, 2011, Satou, et al.

*Primary Examiner* — Patrick Ryan
*Assistant Examiner* — Yoshitoshi Takeuchi
(74) *Attorney, Agent, or Firm* — Oblon, Spivak, McClelland, Maier & Neustadt, L.L.P.

(57) ABSTRACT

Disclosed herein is a high-strength hot-rolled steel sheet which is characterized by high strength (in terms of tensile strength at 900 MPa level) and excellent combined formability expressed by balance between strength and ductility [tensile strength (TS)×total elongation (El)] and balance between strength and stretch flangeability [tensile strength (TS)×bore expanding ratio (λ)]. The hot-rolled steel sheet contains C: no less than 0.02% and no more than 0.15%, Si: no less than 0.2% and no more than 2.0%, Mn: no less than 0.5% and no more than 2.5%, Al: no less than 0.02% and no more than 0.15%, Cu: no less than 1.0% and no more than 3.0%, Ni: no less than 0.5% and no more than 3.0%, and Ti: no less than 0.03% and no more than 0.5%. (% means mass %) It also has a metallographic structure in longitudinal cross section such that the sum of bainitic ferrite and granular bainitic ferrite accounts for no less than 85% by area.

19 Claims, 3 Drawing Sheets

RELATIONSHIP BETWEEN TS×El BALANCE AND TS×λ BALANCE IN THE STEEL SHEET USED FOR EXPERIMENTS

(56) References Cited

FOREIGN PATENT DOCUMENTS

| | | |
|---|---|---|
| JP | 2003 55737 | 2/2003 |
| JP | 2003 73775 | 3/2003 |
| JP | 2003 73777 | 3/2003 |
| JP | 2003 155541 | 5/2003 |
| JP | 2004 162107 | 6/2004 |
| JP | 2004 225109 | 8/2004 |
| JP | 2004 323917 | 11/2004 |

* cited by examiner

GRANULAR BAINITIC FERRITE STRUCTURE

MAJOR STRUCTURE: BAINITIC FERRITE STRUCTURE

PHOTOGRAPH: SEM PHOTOGRAPH

CONDITION FOR EXPOSURE OF STRUCTURE: ETCHED BY 3% NITAL

PHOTOGRAPH TAKEN BY: SCANNING ELECTORON MICROSCOPE, MODEL JSM-5600, MADE BY NIPPON DENSHI

RELATIONSHIP BETWEEN TS×El BALANCE AND TS×λ BALANCE IN THE STEEL SHEET USED FOR EXPERIMENTS

RELATIONSHIP BETWEEN WINDING TEMPERATURE AND TENSILE STRENGTH IN THE STEEL SHEET USED FOR EXPERIMENTS

HIGH-STRENGTH HOT-ROLLED STEEL SHEET WITH EXCELLENT COMBINED FORMABILITY

TECHNICAL FIELD

The present invention relates to a high-strength hot-rolled steel sheet with excellent combined formability (in terms of good balance between strength and ductility and good balance between strength and stretch flangeability), which will find use in the field of automobiles (trucks and passenger cars) and various industrial machines. Owing to its excellent combined formability, the steel sheet will be effectively used for automotive parts such as suspension parts (including member and arms), chassis, and reinforcing parts in complex shape.

BACKGROUND ART

The recent trend toward weight reduction of automobiles for better fuel economy and improved safety from collisions has led to an increased demand for high-strength hot-rolled steel sheet. The hot-rolled steel sheet for such purposes is usually required to have both good elongation and good stretch flangeability from the standpoint of workability. In the present invention, it is expressed as having "excellent combined formability" which means that it excels in both elongation and stretch flangeability.

A high-strength hot-rolled steel sheet that is formed into parts of complex shape needs to meet requirements for high stretch flangeability when it undergoes stretch flanging and also for high elongation when it undergoes bulging simultaneously. Several methods are known in literature (as listed below) for improving elongation and flangeability separately. However, they have many problems unsolved yet.

Patent Document 1 discloses a steel sheet of bainitic-ferrite structure as a high-strength hot-rolled steel sheet to be formed. This steel sheet, however, is limited in tensile strength to 500 MPa level. Patent Document 2 discloses a steel sheet of bainite structure having a tensile strength exceeding 900 MPa level. This steel sheet, however, is not satisfactory despite its high strength with its total elongation being about 14% (as an index of workability) and its bore expanding ratio (λ) being about 40% (as an index of stretch flangeability).

Patent Document 3 discloses a steel sheet whose structure is composed of ferrite and retained austenite and whose strength is greater than 980 MPa. The steel sheet has a high elongation but is not necessarily satisfactory in stretch flangeability. Also, Patent Document 4 discloses a steel sheet whose structure is composed of ferrite and martensite or composed of ferrite, bainite, and martensite and whose strength is greater than 980 MPa. The steel sheet of such composite structure also exhibits a high elongation in its own way. However, nothing is mentioned about its stretch flangeability, and it will not express high stretch flangeability because it is based on a mixed structure composed of soft ferrite and hard martensite and bainite.

Patent Document 5 discloses a method for improving both strength and ductility by incorporating steel with copper in the state of atomic cluster. This method, however, does not provide a high strength comparable with that achieved by precipitation strengthening. In addition, the steel incorporated with copper exhibits a high strength of 980 MPa level but its bore expanding ratio (λ) as an index of local ductility is about 22% at the highest.

Patent Document 6 discloses a steel which has a composite structure of ferrite and bainite and which is modified by incorporation with copper. The steel, however, is not so high in strength due to insufficient copper added, and it is not intended to improve strength by utilizing the precipitation strengthening of copper.

Patent Document 7 discloses a hot-rolled steel sheet which has improved burring workability and fatigue characteristics by incorporation with copper and titanium. It is based on the idea that copper in the state of solid solution improves fatigue characteristics. The disclosed steel sheet, however, does not meet the requirements for both strength and workability.

Making parts in complex shape by a simple process needs a steel sheet with excellent combined forming performance, which excels in both elongation and stretch flangeability. It is not so difficult to impart such characteristic properties to a mild steel with a low strength. However, it is difficult to make a high-strength steel sheet possess both high elongation and high stretch flangeability (bore expanding ratio: λ). A steel sheet superior in one of these characteristic properties is inferior in the other. A probable reason for this is that elongation is related strongly with the structure of material; that is, a sample with a soft structure such as polygonal ferrite exhibits a high elongation but its stretch flangeability is affected intricately by structure uniformity and the size and distribution of precipitates and inclusions.

Patent Document 1:

Japanese Patent Laid-open No. Hei-6-172924

Patent Document 2:

Japanese Patent Laid-open No. Hei-11-80890

Patent Document 3:

Japanese Patent Laid-open No. 2000-290745

Patent Document 4:

Japanese Patent Laid-open No. 2003-73775

Patent Document 5:

Japanese Patent Laid-open No. 2003-73777

Patent Document 6:

Japanese Patent Laid-open No. 2003-55737

Patent Document 7:

Japanese Patent Laid-open No. 2001-200339

Problems for Solution by the Invention

The present invention was completed in view of the foregoing. It is an object of the present invention to provide a high-strength hot-rolled steel sheet which is free of the above-mentioned problems involved in conventional steel sheets and which is characterized by high strength (in terms of tensile strength at 900 MPa level) and excellent combined formability expressed by balance between strength and ductility [tensile strength (TS)×total elongation (El)] and balance between strength and stretch flangeability [tensile strength (TS)×bore expanding ratio (λ)].

Means for Solution of Problems

According to the present invention, the foregoing problems are solved by a high-strength hot-rolled steel sheet with excellent combined formability which is characterized by containing:

C: no less than 0.02% and no more than 0.15%,

Si: no less than 0.2% and no more than 2.0%,

Mn: no less than 0.5% and no more than 2.5%,

Al: no less than 0.02% and no more than 0.15%,

Cu: no less than 1.0% and no more than 3.0%,

Ni: no less than 0.5% and no more than 3.0%, and
Ti: no less than 0.03% and no more than 0.5%
(% means mass % for chemical components hereinafter)
and also by having a metallographic structure in longitudinal cross section such that the sum of bainitic ferrite and granular bainitic ferrite accounts for no less than 85% by area. "Longitudinal cross section" means a cross section parallel to the rolling direction.

According to the present invention, the foregoing high-strength hot-rolled steel sheet has excellent combined formability as defined by an index of:

$$(TS\times\lambda:MPa\cdot\%)\geqq 146000-5.0\times(TS\times El:MPa\cdot\%)$$

where (TS×λ:MPa·%) denotes balance between strength and stretch flangeability [tensile strength (TS)×bore expanding ratio (λ)] and (TS×El:MPa·%) denotes balance between strength and ductility [tensile strength (TS)×total elongation (El)].

According to the present invention, the foregoing hot-rolled steel sheet may optionally contain at least one additional element selected from those elements listed below for further enhanced strength and formability.
Cr: no less than 0.05% and no more than 1.0%,
Mo: no less than 0.05% and no more than 1.0%,
V: no less than 0.05% and no more than 0.5%,
Nb: no less than 0.005% and no more than 0.5%,
B: no less than 0.0010% and no more than 0.01%, and
Ca: no less than 0.0010% and no more than 0.01%.

Incorporation with such additional elements is also within the scope of the present invention. The lowest amount is considered to be necessary for each element to produce its effects and characteristic properties.

The high-strength hot-rolled steel sheet according to the present invention varies in strength depending on its application area. Therefore, the standard of high strength is not specifically established in the present invention; however, it is usually higher than 900 MPa, preferably higher than 980 MPa.

Effect of the Invention

The present invention realizes a high-strength hot-rolled steel sheet excelling in elongation and stretch flangeability (or strength and combined formability), which is represented by, for example, a thickness of about 2 mm, a tensile strength greater than 900 MPa, and an elongation greater than 15%, with balance between strength and ductility (tensile strength× total elongation) being greater than 14000 MPa·%, bore expanding ratio being greater than 70%, and balance between strength and stretch flangeability (tensile strength×bore expanding ratio) being greater than 70000 MPa·%. Unlike conventional hot-rolled steel sheets which are not widely used from the standpoint of formability, the hot-rolled steel according to the present invention can be applied to various parts of automobiles and industrial machine. It will contribute to cost reduction of parts, thickness reduction of parts, and automotive safety (in case of collision) through improved body performance.

BEST MODE FOR CARRYING OUT THE INVENTION

Figure 1:
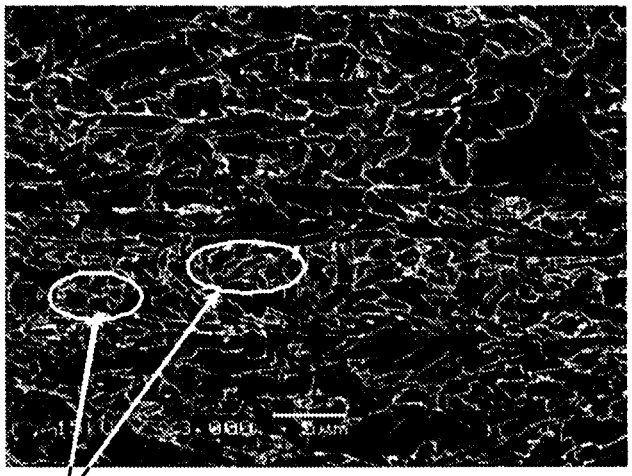
FIG. 1 is an optical microphotograph showing an example of the metallographic structure of the high-strength hot-rolled steel sheet according to the present invention.

As mentioned above, the present invention provides a hot-rolled steel sheet which has high strength as well as excellent combined formability as indicated by improved balance between strength and ductility and improved balance between strength and stretch flangeability. This result is attained by specifying the chemical components of steel and also specifying the metallographic structure in the longitudinal cross section (or L cross section) such that the parent phase is based on bainitic ferrite or granular bainitic ferrite and the parent phase contains fine complex precipitates composed of ε-Cu and titanium carbonitride. The chemical components and metallographic structure are specified by the following reasons.

The chemical components of the steel are specified as follows.

C: no less than 0.02% and no more than 0.15%

C is essential for strength and bainitic ferrite structure. For C to impart a tensile strength greater than 900 MPa, its content should be no less than 0.02%. Excessive C generates and increases the second phase (pearlite and bainite) in the microstructure, thereby deteriorating the bore expanding performance. The maximum C content is 0.15%. The preferred C content is no less than 0.03% and no more than 0.10%.

Si: No Less than 0.2% and No More than 2.0%

Si widens the limits of solid solution of C in ferrite and also gives rise to the bainitic ferrite structure. Si in an adequate amount increases the volume ratio from ferrite structure to bainitic ferrite structure. This structure is hardly subject to voids due to local deformation despite its high strength, and hence it improves bore expanding ratio (λ) and total elongation (El). The bainitic ferrite structure, as compared with ordinary ferrite structure, has a higher dislocation density; however, it is considered to be similar to the ferrite structure in formability unlike the bainite structure, pearlite structure, or the structure containing fine iron carbide dispersed therein. The bainitic ferrite structure needs more than 0.2% of Si. However, excessive Si deteriorates the surface state of the hot-rolled steel sheet and increases the resistance of hot deformation, thereby presenting difficulties in production of steel sheets. The preferred Si content is no less than 0.5% and no more than 1.5%.

Mn: No Less than 0.5% and No More than 2.5%

Mn is effective for solid solution strengthening. At least 0.5% of Mn is necessary to produce a tensile strength greater than 900 MPa. Excessive Mn leads to excessively high hardenability, thereby giving rise to a large amount of product resulting from transformation at low temperatures, which deteriorates the bore expanding ratio (λ). The amount of Mn should be 2.5% at most. The preferred amount of Mn is no less than 0.7% and no more than 2.4%.

Al: No Less than 0.02% and No More than 0.15%

Al is added as a deoxidizer at the time of ingoting to improve the cleanliness of steel. For a good effect, more than 0.02% of Al should be added. However, excessive Al gives rise to non-metallic inclusions, thereby causing surface defects. The upper limit is 0.15%. The preferred amount of Al is no less than 0.03% and no more than 0.1%.

Cu: No Less than 1.0% and No More than 3.0%

Cu is important in the present invention. It contributes to solid solution strengthening and also improves fatigue characteristics. It separates out in the form of fine dispersed ϵ-Cu precipitates during cooling after winding into a coil, thereby contributing to strengthening. Moreover, fine ϵ-Cu precipitates lead to improved balance between strength and ductility and improved balance between strength and stretch flangeability. The reason for this is not known yet but may be explained by the fact that ϵ-Cu precipitates measure about 5-20 nm (as observed under a transmission electron microscope) and that dislocation increases due to work hardening. Enlarged allowance for fracture by the increased dislocation is considered to be one of the reasons.

Although the bore expanding ratio is evaluated by the bore expanding test which is performed on the punched hole formed by shearing, the result of the test varies depending the type of steel tested. A steel whose strength relies on coarse precipitated particles like iron carbide causes a large number of microcracks to occur in the shearing surface when the initial hole is punched out, and such microcracks propagate cracking before bore expanding proceeds sufficiently. Hence the resulting bore expanding ratio (λ) is rather low. By contrast, a steel containing fine ϵ-Cu particles which are uniformly dispersed therein prevents the occurrence of microcracks, and hence it exhibits a high strength and a high bore expanding ratio.

In any case, the steel sheet to have a strength greater than 900 MPa as intended in the present invention should contain more than 1.0% of Cu. The parent material increases in strength with the increasing amount of Cu added. However, excessive Cu causes surface defects, and hence the upper limit is 3.0%. The preferred amount of Cu is no less than 1.0% and no more than 2.5%.

Ni: No Less than 0.5% and No More than 3.0%

Ni effectively prevents surface defects which might occur at the time of hot rolling as the result of incorporation with Cu. If Cu is added, the amount of Ni should preferably be 100% to 50% of Cu. Ni is also effective for solid solution strengthening and hardenability. It increases the dislocation density in the bainitic ferrite structure and granular bainitic ferrite structure, thereby contributing to strength. For Ni to fully produce its effect and make the foregoing steel of composite structure exhibit a tensile strength greater than 900 MPa, the amount of Ni should preferably be more than 0.5%. Excess Ni over about 3.0% is wasted without additional effect. The preferred amount of Ni is no less than 0.5% and no more than 2.5%.

Ti: No Less than 0.03% and No More than 0.5%

Ti dissolves in steel (to make a solid solution) when the slab is heated before hot rolling. The dissolved Ti prevents nucleation of polygonal ferrite at the time of quenching after hot rolling, thereby promoting the formation of granular bainitic ferrite structure and bainitic ferrite structure with a high dislocation density. For Ti to fully produce its effect, the content of Ti should be no less than 0.03%, preferably no less than 0.05%. However, excess Ti causes the hot-worked structure to remain as such, thereby preventing the formation of adequate metallographic structure. The adequate amount of Ti should be less than 0.5%.

The excellent working characteristics in terms of good balance between elongation and stretch flangeability which is featured by the present invention is presumably due to the metallographic structure (mentioned later in more detail) which is composed of bainitic ferrite (or in combination with granular bainitic ferrite) as a major component and fine ϵ-Cu and carbonitride of Ti (or with Nb) in such a way that the major and secondary components precipitate in good matching with the base material.

The steel sheet according to the present invention contains essential elements as mentioned above, with the remainder being substantially iron and inevitable impurities. The latter includes P (phosphorus), S (sulfur), O (oxygen), and N (nitrogen), which originate from iron source (such as iron ores and scraps) or enter in the manufacturing process. To minimize their adverse effect, their content should be kept respectively less than 0.08% (P), 0.010% (S), 0.003% (O), and 0.006% (N).

Of these impurities, P produces the effect of solid solution strengthening without deteriorating ductility. It may be intentionally added in small amounts to enhance strength without the possibility of impairing ductility (elongation and bore expanding performance) due to bainitic ferrite structure. However, an excess amount of P remarkably deteriorates impact properties and spot weldability. An adequate amount of P is less than 0.08%, preferably less than 0.05%. Also, the amount of S should be less than 0.010%, preferably less than 0.005%, because excess S gives rise to sulfide inclusions which adversely affect bore expanding performance.

Moreover, the steel sheet according to the present invention may contain optional elements (mentioned below) for additional characteristic properties. The one containing such optional elements is also within the scope of the present invention.

Mo, Cr: 0.05-1.0% Each

These elements contribute to solid solution strengthening and promote transformation (thereby giving rise to granular bainitic ferrite structure and bainitic ferrite structure). They produce their effect when added in small amounts, preferably more than 0.05%. However, when added in excess amounts, they give rise to a large amount of low-temperature transformation products (such as martensite and M/A transformation products) which adversely affect stretch flangeability. Their amount should be less than 1.0% each.

V: 0.05-0.5%

V forms carbide, nitride, or carbonitride, thereby strengthening the steel sheet. It produces its effect when added in an amount more than 0.05%. However, an adequate amount is less than 0.5% because excess V adversely affects stretch flangeability and gives rise to a large amount of low-temperature transformation products.

Nb: 0.005-0.5%

Like Ti mentioned above, Nb dissolves in steel to form solid solution during slab heating that precedes hot rolling, so that it prevents nucleation of polygonal ferrite during quenching that follows hot rolling, thereby forming granular bainitic ferrite structure and bainitic ferrite structure, both having a high dislocation density. It fully produces its effect when added in an amount more than 0.005%. However, excess Nb causes the hot-rolled structure to remain as such and prevents the formation of adequate metallographic structure. The amount of Nb should be less than 0.5%.

B: 0.0010-0.01%

B improves hardenability and promotes formation of granular bainitic ferrite structure and bainitic ferrite structure. It fully produces its effect when added in an amount more than 0.0010%. However, excess B forms harmful non-metallic inclusions to deteriorate the bore expanding performance. The amount of B should be less than 0.01%, preferably less than 0.005%.

Ca: 0.0010-0.01%

Ca combines with S in steel to form immobile spherical sulfides (CaS) harmless to stretch flangeability, thereby preventing formation of MnS detrimental to bore expanding performance. It fully produces its effect when added in an amount more than 0.0010%. However, when added in an amount more than 0.01%, it is wasted without additional effect.

The following deals with the metallographic structure of the high-strength hot-rolled steel sheet according to the present invention.

The present invention requires that the hot-rolled steel sheet have the composition specified above and the major metallographic structure in its longitudinal cross section (L cross section) is bainitic ferrite structure alone or in combination with granular bainitic ferrite structure.

The granular bainitic ferrite structure and bainitic ferrite structure mentioned above show an acicular shape in observation under an optical microscope or SEM, and they needs identification by observation of their base structure under a transmission electron microscope.

The bainitic ferrite structure has a higher dislocation density than the polygonal ferrite structure and looks like a lath. The bainite structure has a lathlike underlying structure with a high dislocation density, with carbide being formed in the lath boundary. By contrast, the bainitic ferrite structure has the lath structure but is free of cementite in an ideal case. So, it is different from the bainite structure. On the other hand, the granular bainitic ferrite structure does not have the lathlike structure but has the underlying structure with a high dislocation density. They apparently differ from the bainite structure in that they have no cementite in the structure. They also differ from either polygonal ferrite having the underlying structure with an extremely low dislocation density or quasi-polygonal ferrite having the underlying structure such as fine subgrains. (Refer to "Collection of Photographs of Bainite in Steel-1" issued by the Japanese Steel Association, Fundamental Workshop, Jun. 29, 1992.)

It is essential for the hot-rolled steel sheet according to the present invention to have the granular bainitic ferrite structure and bainitic ferrite structure mentioned above as its main structure. However, practically, it may have either of them or both mixed together. In any case, it is necessary that their sum should account for no less than 85% (by area), preferably no less than 90%, in all the metallographic structure. In other words, the product is acceptable in the present invention even though it contains a small amount of foreign structure (other than mentioned above) in an amount less than 15%, preferably less than 10%.

The above-mentioned areal ratio for the metallographic structure is determined by observation under an optical microscope in the following manner. An embedded specimen has its cross section (parallel to the rolling direction) polished and then etched by immersion in a Nital solution. That part of the specimen which is away from the surface by one quarter of the thickness is examined for structure by observation under an optical microscope (×400), Model PMG-II made by Olympus. The field of view is divided by a grid consisting of twenty each of horizontal and vertical lines. The phase at each intersection is determined. Observation in this manner is repeated for five view fields of each specimen. Thus, the number of different phases at 2000 intersections in total is counted to obtain the areal ratio.

FIG. 1 is an optical microphotograph showing an example of the metallographic structure. It shows that the steel in question is composed of bainitic ferrite as the main structure and granular bainitic ferrite surrounded by ellipses. Incidentally, different microscopes were used to determine the fraction of structure and to photograph the structure.

The hot-rolled steel sheet according to the present invention exhibits high strength and high bore expanding ratio on account of monolayer structure of bainitic ferrite formed therein or dual layer structure of granular bainitic ferrite and bainitic ferrite formed therein, the former containing a reduced amount of C, having the lathlike structure, and having a high dislocation density free of carbides, and the latter containing no carbides precipitating therein. The high strength of the steel sheet is attributable to solid solution strengthening due to alloying elements added (particularly Cu that forms ε-Cu in bainitic ferrite to bring about fine precipitation strengthening), improved hardenability due to alloying elements added, and increased dislocation density of bainitic ferrite associated therewith.

In any case, it is the essential requirement of the present invention that the longitudinal cross section of the specimen observed in the above-mentioned manner has a metallographic structure composed mainly of bainitic ferrite alone or in combination with granular bainitic ferrite. If this structure is absent, the steel sheet will not meet the requirement of the present invention—good balance between strength and stretch flangeability [tensile strength (TS)×bore expanding ratio (λ):MPa·%] and good balance between strength and ductility [tensile strength (TS)×elongation (El): MPa·%]—which will be mentioned below in more detail.

[Balance Between Strength and Workability]

The high-strength hot-rolled steel sheet according to the present invention is characterized by having a good balance between high strength and workability which is achieved by the above-mentioned composition and metallographic structure in the cross section. This is quantified by the statement that balance between strength and stretch flangeability [tensile strength (TS)×bore expanding ratio (λ):MPa·%] and balance between strength and ductility [tensile strength (TS)×elongation (El): MPa·%] meet the formula (I) below.

$$(TS\times\lambda:MPa\cdot\%)\geqq 146000-5.0\times(TS\times El:MPa\cdot\%) \quad (I)$$

The bore expanding ratio (λ) of the hot-rolled steel sheet is a characteristic value that indicates the uniformity of the structure. The requirement for this characteristic property is best achieved by a steel of single structure. On the other hand, total elongation depends on the ratio of the soft phase in a steel, and hard phases are desirable for high strength. Therefore, a steel with both high strength and high ductility should have a mixed structure of soft phase and hard phase. Such a structure, however, is inhomogeneous and reduces the bore expanding ratio (λ). A detailed study on the metallographic structure of the hot-rolled steel sheet revealed that strength, ductility, and stretch flangeability are affected by the size, shape, distribution, and particle-to-particle distance of precipitates. It also revealed that stretch flangeability (bore expanding ratio: λ), which is local ductility, is inversely proportional to ductility (or total elongation: El).

Figure 2:
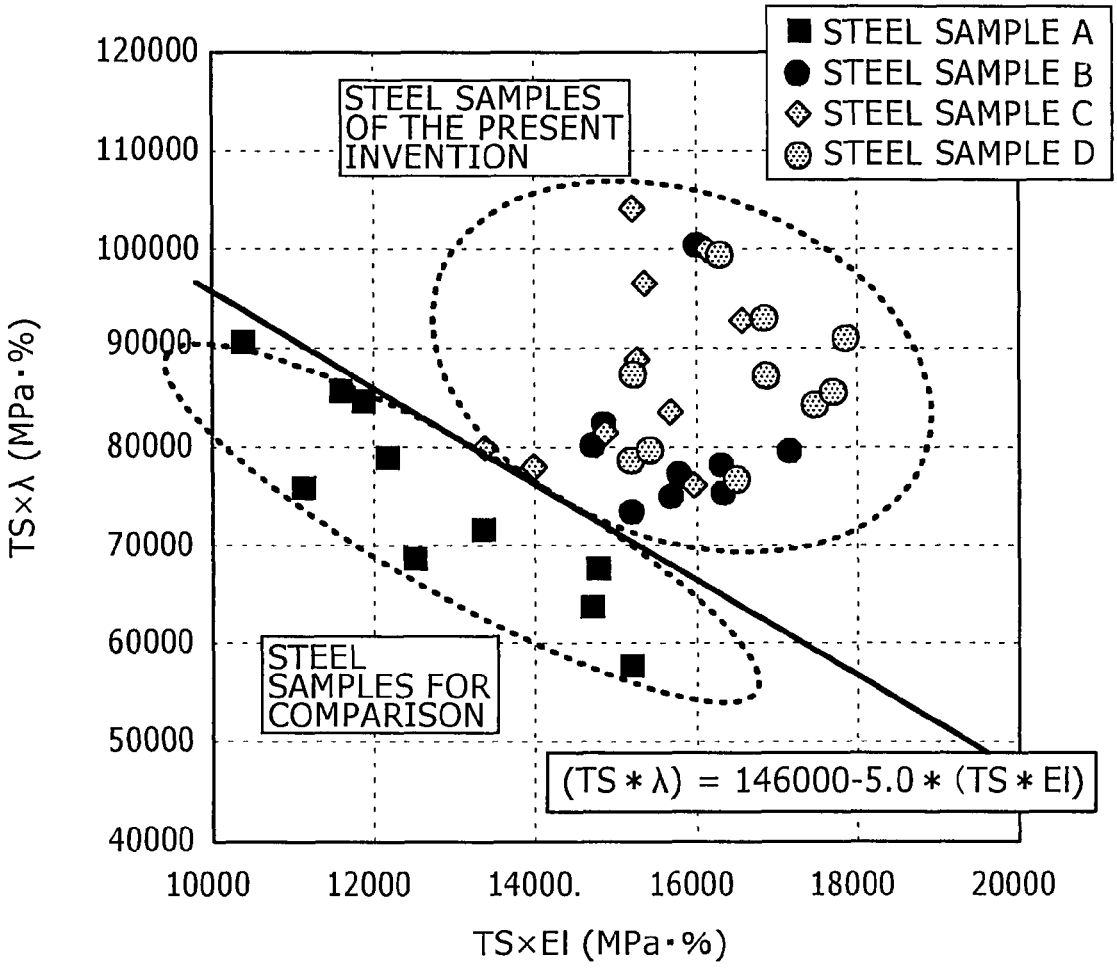
FIG. 2 is a graph showing the relation between tensile strength (TS)×elongation (El) and tensile strength (TS)× stretch flangeability (λ), which is observed in one steel sheet obtained by experiments.

Further studies on this relationship revealed that a high-strength steel sheet having a tensile strength greater than 900 MPa that satisfies the formula (I) above excels not only in strength but also in balance between strength and ductility and balance between strength and stretch flangeability. Incidentally, FIG. 2 is a graph showing the relation between (TS×El) and (TS×λ) which is based on data collected from many experiments including Examples mentioned later. It is apparent from the graph that the formula (I) given above draws a clear distinction between the steel according to the present invention (which has the composition and metallographic structure as specified in the present invention) and the steel for comparison (which does not meet the requirements of the present invention).

The following deals with the manufacturing condition for the hot-rolled steel sheet that has the metallographic structure as specified above.

The hot-rolled steel sheet according to the present invention is produced by the steps of making a steel having the composition mentioned above, casting the steel into ingots, and performing heating, hotrolling, and winding in the usual way. Important factors to control the metallographic structure include heating temperature, finishing temperature of hot rolling, cooling pattern after hot rolling, winding condition, and cooling condition after winding. Such conditions are mentioned in the following.

[Heating Temperature]

The slab heating temperature prior to hot rolling should be no lower than 1150° C. This temperature is just high enough for TiC and NbC to begin dissolving in austenite. Heating above this temperature is necessary for Ti and optional Nb to dissolve in steel. The Ti and Nb which have dissolved in steel and the dissolved C prevent the formation of polygonal ferrite at the time of quenching that follows hot rolling, thereby promoting the formation of granular bainitic ferrite structure and bainitic ferrite structure having a high dislocation density. This realizes tensile strength as well as elongation and stretch flangeability as desired.

[Finishing Temperature of Hot Rolling]

Hot rolling can be accomplished in the usual way without specific restrictions. The finishing temperature of hot rolling should be higher than the $Ar_3$ transformation point in the single phase of austenite. If hot rolling ends at a temperature lower than the $Ar_3$ transformation point, finish rolling leaves two-phase structure of ferrite and austenite. Accordingly, worked ferrite remains and the resulting hot-rolled steel sheet is poor in ductility and bore expanding performance. Such a steel sheet also has a coarse grainy structure in the surface layer, which lowers elongation. Moreover, hot rolling with a lower finishing temperature than specified causes the dissolved Ti and Nb to precipitate in the form of carbonitride and does not provide a steel sheet of the desired structure. As the result, the desired strength and elongation cannot be obtained. However, an excessively high finishing temperature leads to the formation of polygonal ferrite structure. The finishing temperature should not exceed "$Ar_3$+100° C." at the highest.

[Cooling Rate and Cooling Pattern after Hot Rolling]

Cooling after hot rolling should be carried out at an average cooling rate no lower than 20° C./sec. Cooling slower than this rate will not prevent transformation of polygonal ferrite with a low dislocation density. The resulting steel sheet does not have the areal ratio for granular bainitic ferrite structure and granular bainitic ferrite structure as specified in the present invention.

A desirable cooling pattern is step cooling which includes air cooling for a short time during cooling. This is because cooling without pausing from the finishing temperature of hot rolling down to the winding temperature does not provide sufficient time for carbonitrides of Ti and Nb to precipitate in the steel, which results in a low strength. The temperature of air cooling should be 620° C. to 720° C. Air cooling at a temperature exceeding 720° C. retards precipitation of Ti and Nb carbonitrides, resulting in insufficient precipitates. Air cooling at a temperature below 620° C. also retards precipitation of Ti and Nb carbonitrides, and air cooling takes a long time, which deteriorates productivity. Therefore, the preferred temperature for air cooling ranges from 650° C. to 700° C.

Duration of air cooling should be at least about 0.2 seconds for precipitation of Ti (and Nb) carbonitrides. Extending the duration of air cooling without purpose necessitates an extension of the production line or a reduction of sheet passing time. This is disadvantageous to productivity. Therefore, the duration of air cooling should be shorter than 10 seconds.

[Winding Condition]

The temperature for winding should be 400-600° C. This is because winding at this temperature results in a steel sheet whose cross section has the main structure of single phase of bainitic ferrite or dual phase of granular bainitic phase and bainitic ferrite, and cooling that follows winding causes dissolved Cu to precipitate in the form of fine ϵ-Cu, thereby providing the desired strength and the intended total elongation and stretch flangeability. Winding at a temperature below 400° C. permits entrance of bainite structure, thereby decreasing elongation, and prevents sufficient precipitation of ϵ-Cu, which leads to insufficient strength and inadequate characteristic properties. For a good balance between strength and ductility, the winding temperature should be higher than 450° C.

By contrast, winding at a temperature above 600° C. results in a steel sheet of low strength which has the polygonal ferrite structure with a low dislocation density. Moreover, winding at such a low temperature makes fine Ti (and Nb) carbonitrides (which have precipitated in the step of air cooling) coarser, which deteriorates stretch flangeability. Thus, the winding temperature should be 400-600° C., preferably 450-550° C.

[Condition of Cooling after Winding]

The wound coil should be cooled at an average cooling rate higher than 50° C./hr so as to prevent segregation of P (which is inevitably contained in steel) in ferrite grain boundaries. The average cooling rate should be higher than 50° C./hr for cooling from the winding temperature to 300° C. Slower cooling than specified above brings about segregation of P in ferrite grain boundaries during cooling, resulting in a high fracture appearance transition temperature (vTrs) obtained by impact test, which leads to an unsatisfactory bore expanding ratio (λ).

The above-mentioned cooling rate may be achieved by any means without specific restrictions, such as blasting a wound coil by blowers, blasting with mist (cooling by blast+mist), water spraying from nozzles, and dipping a wound coil in water.

The foregoing is the constitution of the present invention. The hot-rolled steel sheet according to the present invention has an extraordinary high strength of 900 MPa level and excellent workability in terms of elongation and stretch flangeability on account of its specific composition (including C, Si, and Mn as steel's fundamental elements and Cu, Ti, and Ni as essential elements in a small amount) and also on account of its specific metallographic structure based on bainitic ferrite alone or in combination with granular bainitic ferrite.

The present invention will be described in more detail with reference to the following examples, which are not intended to restrict the scope thereof and which may be changed and modified adequately within the scope thereof.

Example 1

A steel slab having the chemical composition shown in Table 1 was heated and kept at 1250° C. for 30 minutes and then hot-rolled in the usual way, with the finishing temperature being 910-950° C., to be made into a 3-mm thick hot-rolled steel sheet. The hot-rolled steel sheet was cooled by showering at an average cooling rate of 50° C./sec. During cooling, showering was interrupted to measure the temperature of the steel sheet, and air cooling was carried out for a prescribed period of time. Showering was resumed and carried out under the same condition as above. After cooling, the steel sheet was wound and kept at 400-600° C. for 30 minutes in an electric heating furnace. The steel sheet was removed from the electric furnace and cooled to room temperature at various cooling rates. Thus there was obtained the hot-rolled steel sheet as desired.

The specimens (conforming to JIS No. 5) of the hot-rolled steel sheets thus obtained underwent tensile test (in the direction parallel to the rolling direction), bore expanding test, and observation of structure. Incidentally, each specimen was prepared by grinding the hot-rolled steel sheet to reduce its thickness to 2.0 mm. The bore expanding test conforms to the standard JFST 1001-1996 of the Japan Iron and Steel Federation. This test consists of punching a hole (10 mm in diameter) and expanding the hole with a conical punch having an apex angle of 60°. The diameter (d) of the hole is measured when cracking penetrates the thickness of the steel sheet. The bore expanding ratio (λ) is calculated from the following formula.

$$\lambda=[(d-d_o)/d_o]\times 100(\%)\ (d_o=10\text{ mm})$$

Figure 3:
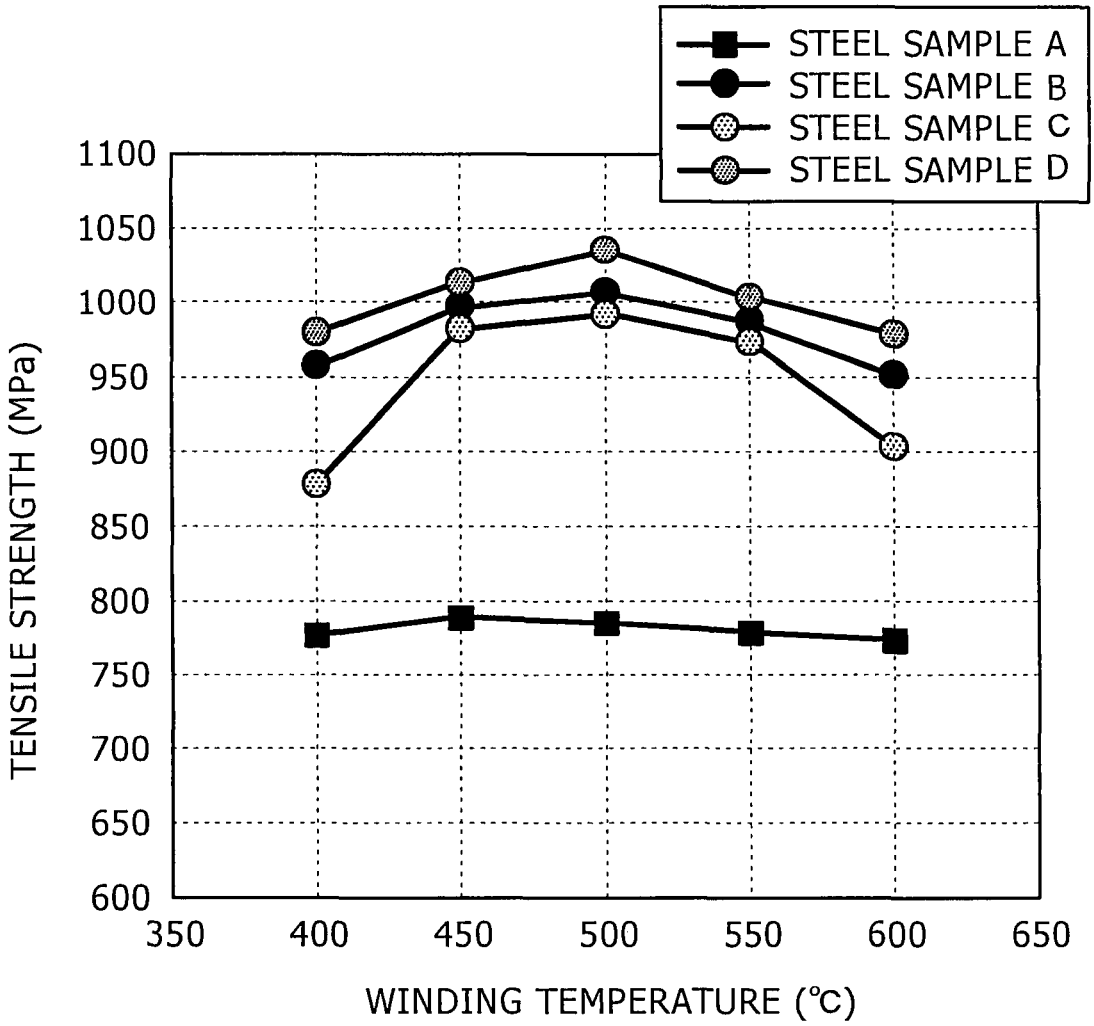
FIG. 3 is a graph showing the relation between winding temperature and tensile strength which is found in a steel sheet used in experiments.

The results are shown in Tables 2 and 3 and FIGS. 2 and 3. Incidentally, the $Ar_3$ transformation point of the specimen was calculated from the formula below.

$$Ar_3=910-203\sqrt{N}/[\%\ C]+44.5[\%\ Si]-20[\%\ Mn]-20[\%\ Cu]-15.2[\%\ Ni]-400[\%\ Ti]$$

where [% element] means the content (mass %) of each element.

TABLE 1

| Chemical Composition (mass %) | | | | | | | | | | | |
|---|---|---|---|---|---|---|---|---|---|---|---|
| Steel sample | C | Si | Mn | P | S | Al | Cu | Ni | Ti | $Ar_3$ transformation point | Remarks |
| A | 0.05 | 0.94 | 1.36 | 0.008 | 0.005 | 0.035 | 0.03 | 0.02 | 0.153 | 926 | Steel for comparison |
| B | 0.04 | 1.06 | 1.45 | 0.008 | 0.005 | 0.041 | 1.47 | 0.78 | 0.149 | 906 | Steel of the present invention |
| C | 0.05 | 0.96 | 1.37 | 0.007 | 0.005 | 0.037 | 0.99 | 0.52 | 0.147 | 911 | Steel of the present invention |
| D | 0.05 | 1.00 | 1.36 | 0.008 | 0.005 | 0.038 | 2.00 | 1.01 | 0.154 | 888 | Steel of the present invention |

TABLE 2

| Steel sample | Condition No. | Finishing temperature (° C.) | Cooling rate (° C./sec) | Cooling condition: Step temperature | Cooling condition: Duration of air cooling | Winding temperature (° C.) | YS ($N/mm^2$) | TS ($N/mm^2$) |
|---|---|---|---|---|---|---|---|---|
| A | 1 | 950 | 50 | 680° C. | 15 sec | 600 | 671.4 | 771.7 |
| | 2 | | | | | 550 | 676.9 | 778.0 |
| | 3 | | | | | 500 | 682.7 | 784.7 |
| | 4 | | | | | 450 | 687.1 | 789.8 |
| | 5 | | | | | 400 | 877.1 | 778.3 |
| | 6 | 930 | 50 | 680° C. | 20 sec | 600 | 665.9 | 765.4 |
| | 7 | | | | | 550 | 680.2 | 781.8 |
| | 8 | | | | | 500 | 683.6 | 785.7 |
| | 9 | | | | | 450 | 688.3 | 791.2 |
| | 10 | | | | | 400 | 704.3 | 809.5 |
| B | 11 | 930 | 50 | 680° C. | 15 sec | 600 | 826.9 | 950.5 |
| | 12 | | | | | 550 | 858.0 | 986.2 |
| | 13 | | | | | 500 | 875.7 | 1006.5 |
| | 14 | | | | | 450 | 868.5 | 998.3 |
| | 15 | | | | | 400 | 835.4 | 960.2 |
| | 16 | 910 | 50 | 680° C. | 20 sec | 600 | 842.6 | 968.5 |
| | 17 | | | | | 550 | 865.1 | 994.4 |
| | 18 | | | | | 500 | 871.7 | 1001.9 |
| | 19 | | | | | 450 | 863.2 | 992.2 |
| | 20 | | | | | 400 | 853.9 | 981.5 |

| Steel sample | Condition No. | EI (%) | λ (%) | TSxEI MPa-% | TSxλ MPa-% | Major structure (area %) | Remaining structure (area %) | Remarks |
|---|---|---|---|---|---|---|---|---|
| A | 1 | 19.7 | 69.3 | 15202.5 | 53478.8 | BF(95) | B(5) | Comparative Examples |
| | 2 | 16.1 | 88.0 | 12525.8 | 68464.0 | BF(95) | B(5) | Comparative Examples |
| | 3 | 15.1 | 107.7 | 11849.0 | 84512.2 | BF(92) | B(8) | Comparative Examples |
| | 4 | 14.1 | 95.8 | 11136.2 | 75662.8 | BF(90) | B(10) | Comparative Examples |
| | 5 | 14.9 | 110.2 | 11596.7 | 85768.7 | BF(85) | B(15) | Comparative Examples |
| | 6 | 19.3 | 93.1 | 14772.2 | 71258.7 | BF(93) | B(7) | Comparative Examples |

TABLE 2-continued

| | | | | | | | | | |
|---|---|---|---|---|---|---|---|---|---|
| | | 7 | 17.1 | 91.3 | 13368.8 | 71378.3 | BF(95) | B(5) | Comparative Examples |
| | | 8 | 18.7 | 80.8 | 14692.6 | 63484.6 | BF(93) | B(7) | Comparative Examples |
| | | 9 | 15.4 | 99.5 | 12184.5 | 78724.4 | BF(88) | B(12) | Comparative Examples |
| | | 10 | 12.8 | 111.6 | 10361.6 | 90340.2 | BF(83) | B(17) | Comparative Examples |
| | B | 11 | 16.5 | 78.7 | 15683.3 | 74804.4 | BF(95) | B(5) | Working Examples |
| | | 12 | 17.4 | 80.7 | 17159.9 | 79586.3 | BF(96) | B(4) | Working Examples |
| | | 13 | 15.9 | 99.7 | 16003.4 | 100348.1 | BF(98) | B(2) | Working Examples |
| | | 14 | 15.8 | 77.2 | 15773.1 | 77068.8 | BF(97) | B(3) | Working Examples |
| | | 15 | 15.3 | 83.5 | 14691.1 | 80176.7 | BF(92) | B(8) | Working Examples |
| | | 16 | 16.8 | 102.4 | 16270.8 | 99174.4 | BF(92) | B(8) | Working Examples |
| | | 17 | 16.4 | 78.5 | 16308.2 | 78060.4 | BF(95) | B(5) | Working Examples |
| | | 18 | 16.3 | 75.2 | 16331.0 | 75342.9 | BF(97) | B(3) | Working Examples |
| | | 19 | 15.3 | 73.9 | 15180.7 | 73323.6 | BF(91) | B(9) | Working Examples |
| | | 20 | 15.1 | 83.6 | 14820.7 | 82053.4 | BF(90) | B(10) | Working Examples |

TABLE 3

| | | Finishing | Cooling | Cooling condition | | Winding | | |
|---|---|---|---|---|---|---|---|---|
| Steel sample | Condition No | temperature (° C.) | rate (° C./sec) | Step temperature | Duration of air cooling | temperature (° C.) | YS ($N/mm^2$) | TS ($N/mm^2$) |
| C | 21 | 935 | 50 | 680° C. | 15 sec | 600 | 785.2 | 902.5 |
| | 22 | | | | | 550 | 847.3 | 973.9 |
| | 23 | | | | | 500 | 863.4 | 992.4 |
| | 24 | | | | | 450 | 855.6 | 983.4 |
| | 25 | | | | | 400 | 766.0 | 880.5 |
| | 26 | 915 | 50 | 680° C. | 20 sec | 600 | 801.2 | 920.9 |
| | 27 | | | | | 550 | 860.3 | 988.9 |
| | 28 | | | | | 500 | 857.1 | 985.2 |
| | 29 | | | | | 450 | 838.9 | 964.3 |
| | 30 | | | | | 400 | 794.7 | 913.4 |
| D | 31 | 930 | 50 | 680° C. | 15 sec | 600 | 877.2 | 1008.3 |
| | 32 | | | | | 550 | 889.3 | 1022.2 |
| | 33 | | | | | 500 | 935.3 | 1075.1 |
| | 34 | | | | | 450 | 908.6 | 1044.4 |
| | 35 | | | | | 400 | 880.7 | 1012.3 |
| | 36 | 910 | 50 | 680° C. | 20 sec | 600 | 861.5 | 990.2 |
| | 37 | | | | | 550 | 875.4 | 1006.2 |
| | 38 | | | | | 500 | 912.3 | 1048.6 |
| | 39 | | | | | 450 | 894.1 | 1027.7 |
| | 40 | | | | | 400 | 870.261 | 1000.3 |

| Steel sample | Condition No | EI (%) | λ (%) | TSxEI MPa-% | TSxλ MPa-% | Major structure (area %) | Remaining structure (area %) | Remarks |
|---|---|---|---|---|---|---|---|---|
| C | 21 | 17.7 | 84.3 | 15974.3 | 76080.8 | BF(93) | B(7) | Working Examples |
| | 22 | 17.0 | 95.2 | 16556.3 | 92715.3 | BF(95) | B(5) | Working Examples |
| | 23 | 16.2 | 100.9 | 16076.9 | 100133.2 | BF(95) | B(5) | Working Examples |
| | 24 | 15.4 | 105.8 | 15144.4 | 104043.7 | BF(94) | B(6) | Working Examples |
| | 25 | 15.2 | 90.3 | 13383.6 | 79509.2 | BF(89) | B(11) | Working Examples |
| | 26 | 16.1 | 88.4 | 14826.5 | 81407.6 | BF(91) | B(9) | Working Examples |
| | 27 | 15.5 | 97.5 | 15328.0 | 96417.8 | BF(94) | B(6) | Working Examples |
| | 28 | 15.9 | 84.9 | 15664.7 | 83643.5 | BF(95) | B(5) | Working Examples |

TABLE 3-continued

| | | | | | | | | |
|---|---|---|---|---|---|---|---|---|
| | 29 | 15.8 | 91.8 | 15235.9 | 88522.7 | BF(93) | B(7) | Working Examples |
| | 30 | 15.3 | 85.3 | 13975.0 | 77913.0 | BF(90) | B(10) | Working Examples |
| D | 31 | 16.7 | 92.3 | 16838.6 | 93066.1 | BF(95) | B(5) | Working Examples |
| | 32 | 17.1 | 82.5 | 17479.6 | 84331.5 | BF(96) | B(4) | Working Examples |
| | 33 | 16.6 | 84.6 | 17846.7 | 90953.5 | BF(98) | B(2) | Working Examples |
| | 34 | 15.8 | 73.2 | 16501.5 | 76450.1 | BF(97) | B(3) | Working Examples |
| | 35 | 15.0 | 77.5 | 15184.5 | 78453.3 | BF(94) | B(6) | Working Examples |
| | 36 | 16.4 | 100.7 | 16239.3 | 99713.1 | BF(92) | B(8) | Working Examples |
| | 37 | 17.6 | 85.0 | 17709.1 | 85527.0 | BF(95) | B(5) | Working Examples |
| | 38 | 16.1 | 83.1 | 16882.5 | 87138.7 | BF(97) | B(3) | Working Examples |
| | 39 | 15.0 | 77.3 | 15415.5 | 79441.2 | BF(89) | B(11) | Working Examples |
| | 40 | 15.2 | 87.3 | 15204.6 | 87326.2 | BF(88) | B(12) | Working Examples |

Tables 1 to 3 and FIGS. 2 and 3 suggest the following.

All the samples B to D, whose composition conforms to the present invention, have the metallographic structure specified in the present invention, because they were produced at the adequate finishing temperature, cooling rate, and winding temperature and by the step cooling method which are recommenced in the present invention (except the one produced under condition No. 10). The sample A for comparison merely contains a small amount of Cu and Ni which are not added intentionally.

The samples B to D, whose composition conforms to the present invention, have a tensile strength (TS) greater than 900 MPa and good elongation (El) and stretch flangeability (λ), with high values of (TS×El) and (TS×λ), which suggests good combined formability. By contrast, the sample A is poor in balance between strength and elongation and balance between strength and stretch flangeability, because it merely contains a small amount of Cu and Ni (which are not added intentionally) and hence it lacks precipitation strengthening due to precipitation of fine ε-Cu. Moreover, it does not have a tensile strength reaching the 900 MPa level regardless of manufacturing conditions on account of lack of Ni solid solution strengthening and improved hardenability. It is inferior in (TS×E) and/or (TS×λ) to the samples conforming to the present invention.

Moreover, it is apparent from FIG. 2, in which (TS×λ) is plotted against (TS×El), that the line representing the formula (I) separates the samples B to D conforming to the present invention from the sample A for comparison. This means that the former excels in both (TS×El) and (TS×λ), but the latter does not.

FIG. 3 is a graph which has been compiled from data shown in Table 1 to 3 to show the relationship between tensile strength and winding temperature. It indicates that the samples B to D (conforming to the present invention) is by far superior in tensile strength to the sample A for comparison, regardless of winding temperature. Such good properties are probably due to precipitation of fine ε-Cu and Ni in the steel.

Example 2

A steel slab having the chemical composition shown in Table 4 was heated and kept at 1250° C. for 30 minutes and then hot-rolled in the usual way, with the finishing temperature being 910-950° C., to be made into a 3-mm thick hot-rolled steel sheet. The hot-rolled steel sheet was cooled at an average cooling rate of 30-100° C./sec. Cooling was interrupted and air cooling was carried out for a prescribed period. The steel sheet, which had undergone step cooling, was cooled by showering to a prescribed temperature. After winding the steel sheet was kept at 300-650° C. for 30 minutes in an electric heating furnace. The steel sheet was removed from the electric furnace and cooled to room temperature at various cooling rates. Thus there were obtained the samples of hot-rolled steel sheets. Their manufacturing conditions are shown in Table 5.

The hot-rolled steel sheets thus obtained were tested for tensile strength (with JIS No. 5 specimens) and bore expanding performance and also examined under an optical microscope in the same way as mentioned above. The results are shown in Table 6.

TABLE 4

| | Chemical Composition (mass %) | | | | | | | | | | | |
|---|---|---|---|---|---|---|---|---|---|---|---|---|
| Steel sample | C | Si | Mn | P | S | Al | Cu | Ni | Ti | Others | $Ar_3$ transformation point (° C.) | Remarks |
| 1 | 0.05 | 0.96 | 1.37 | 0.007 | 0.005 | 0.037 | 1.02 | 0.52 | 0.147 | | 897 | Steel of the present invention |
| 2 | 0.05 | 1.00 | 1.36 | 0.008 | 0.005 | 0.038 | 1.50 | 1.01 | 0.154 | | 885 | Steel of the present invention |
| 3 | 0.03 | 1.50 | 1.80 | 0.010 | 0.002 | 0.045 | 1.00 | 0.73 | 0.120 | | 904 | Steel of the present invention |

TABLE 4-continued

| Steel sample | C | Si | Mn | P | S | Al | Cu | Ni | Ti | Others | $Ar_3$ transformation point (° C.) | Remarks |
|---|---|---|---|---|---|---|---|---|---|---|---|---|
| | Chemical Composition (mass %) | | | | | | | | | | | |
| 4 | 0.08 | 1.02 | 1.51 | 0.009 | 0.003 | 0.035 | 2.00 | 1.35 | 0.348 | | 931 | Steel of the present invention |
| 5 | 0.04 | 0.51 | 1.92 | 0.010 | 0.004 | 0.035 | 1.50 | 1.08 | 0.180 | Nb: 0.035, Mo: 0.5 | 860 | Steel of the present invention |
| 6 | 0.06 | 1.80 | 1.11 | 0.015 | 0.006 | 0.052 | 2.00 | 1.52 | 0.240 | Cr: 0.5 | 934 | Steel of the present invention |
| 7 | 0.05 | 0.92 | 1.40 | 0.008 | 0.003 | 0.048 | 1.50 | 0.82 | 0.160 | V: 0.3 | 885 | Steel of the present invention |
| 8 | 0.04 | 1.10 | 2.23 | 0.013 | 0.002 | 0.048 | 1.75 | 1.03 | 0.180 | Cr: 0.3, Mo: 0.2 | 873 | Steel of the present invention |
| 9 | 0.07 | 1.01 | 0.79 | 0.011 | 0.007 | 0.054 | 2.50 | 1.50 | 0.304 | Ca: 0.0030 | 926 | Steel of the present invention |
| 10 | 0.10 | 0.35 | 2.40 | 0.015 | 0.003 | 0.035 | 2.00 | 1.00 | 0.400 | B: 0.0027 | 894 | Steel for comparison |
| 11 | 0.20 | 1.04 | 1.32 | 0.009 | 0.002 | 0.052 | 1.10 | 0.50 | 0.150 | | 856 | Steel for comparison |
| 12 | 0.05 | 0.02 | 1.61 | 0.008 | 0.004 | 0.048 | 1.03 | 0.53 | 0.130 | | 841 | Steel for comparison |
| 13 | 0.04 | 1.00 | 3.00 | 0.007 | 0.003 | 0.052 | 1.50 | 0.75 | 0.140 | | 839 | Steel for comparison |
| 14 | 0.05 | 1.01 | 1.38 | 0.009 | 0.006 | 0.042 | 3.50 | 2.00 | 0.160 | | 832 | Steel for comparison |
| 15 | 0.05 | 0.99 | 1.33 | 0.014 | 0.005 | 0.033 | 0.50 | 0.50 | 0.163 | | 916 | Steel for comparison |

TABLE 5

| Steel sample | Condition No. | Finishing temperature (° C.) | Cooling rate (° C./sec) | Cooling condition: Step temperature | Cooling condition: Duration of air cooling | Winding temperature (° C.) | Cooling rate after winding (° C./hr) | Remarks |
|---|---|---|---|---|---|---|---|---|
| 1 | 21 | 930 | 50 | 680° C. | 20 sec | 500 | 100 | Working Example |
| | 22 | | | | | 450 | 100 | Working Example |
| | 23 | | | | | 300 | 100 | Comparative Example |
| 2 | 24 | 910 | 50 | None | None | 650 | 100 | Comparative Example |
| | 25 | | 70 | 670° C. | 15 sec | 500 | 80 | Working Example |
| | 26 | | | | | 450 | 80 | Working Example |
| 3 | 27 | 930 | 70° C./sec | None | None | 650 | 80 | Comparative Example |
| | 28 | | 30 | 650° C. | 30 sec | 550 | 150 | Working Example |
| | 29 | | | | | 500 | 150 | Working Example |
| | 30 | | | | | 450 | 150 | Working Example |
| 4 | 31 | 950 | 50 | 650° C. | 30 sec | 500 | 120 | Working Example |
| | 32 | | | | | 450 | 120 | Working Example |
| | 33 | | | | | 300 | 120 | Comparative Example |
| 5 | 34 | 930 | 50 | 700° C. | 15 sec | 500 | 80 | Working Example |
| | 35 | 910 | | | | 500 | 80 | Working Example |
| | 36 | | | | | 450 | 50 | Working Example |
| 6 | 37 | 950 | 30 | 675° C. | 20 sec | 500 | 50 | Working Example |
| | 38 | | | | | 450 | 50 | Working Example |
| | 39 | 930 | 50 | | | 500 | 120 | Working Example |
| | 40 | | | | | 450 | 120 | Working Example |
| 7 | 41 | 930 | 50 | 675° C. | 20 sec | 550 | 100 | Working Example |
| | 42 | 910 | | | | 550 | 100 | Working Example |
| 8 | 43 | 930 | 50 | 675° C. | 20 sec | 500 | 100 | Working Example |
| | 44 | | | | | 300 | 100 | Comparative Example |
| 9 | 45 | 930 | 70 | 700° C. | 25 sec | 550 | 80 | Working Example |
| | 46 | | | | | 500 | 80 | Working Example |
| | 47 | | | | | 350 | 80 | Comparative Example |
| 10 | 48 | 930 | 50 | 680° C. | 20 sec | 550 | 100 | Working Example |
| | 49 | | | | | 500 | 100 | Working Example |
| | 50 | 910 | | | | 450 | 100 | Working Example |
| 11 | 51 | 910 | 50° C./sec | None | None | 600 | 100 | Comparative Example |
| 12 | 52 | 910 | 50° C./sec | 680° C. | 20 sec | 500 | 80 | Comparative Example |
| 13 | 53 | 910 | 50° C./sec | 680° C. | 20 sec | 500 | 80 | Comparative Example |
| 14 | 54 | 910 | 50° C./sec | 680° C. | 20 sec | 500 | 80 | Comparative Example |
| 15 | 55 | 930 | 50 | 680° C. | 20 sec | 550 | 80 | Comparative Example |
| | 56 | | | | | 500 | 80 | Comparative Example |

TABLE 6

| Steel sample | Condition No. | YS (N/mm$^2$) | TS (N/mm$^2$) | El (%) | λ (%) | TSxEl MPa-% | TSxλ MPa-% | Major structure (area %) | Remaining structure (area %) | Remarks |
|---|---|---|---|---|---|---|---|---|---|---|
| 1 | 21 | 858 | 998 | 16.3 | 82.3 | 16267.4 | 82135.4 | BF(95) | B(5) | Working Example |
| | 22 | 871 | 1013 | 15.2 | 87.2 | 15397.6 | 88333.6 | BF(93) | B(7) | Working Example |
| | 23 | 903 | 1050 | 10.1 | 63.3 | 10605.0 | 66465.0 | M(60) | F(15) + B(25) | Comparative Example |
| 2 | 24 | 797 | 885 | 18.3 | 76.3 | 16195.5 | 67525.5 | P.F(90) | B(10) | Comparative Example |
| | 25 | 914 | 1063 | 16.2 | 92.3 | 17220.6 | 98114.9 | BF(91) | B(9) | Working Example |
| | 26 | 930 | 1081 | 15.1 | 86.2 | 16323.1 | 93182.2 | BF(92) | B(8) | Working Example |
| 3 | 27 | 792 | 880 | 19.2 | 78.4 | 16896.0 | 68992.0 | PF(85) | B(15) | Comparative Example |
| | 28 | 853 | 992 | 17.4 | 91.4 | 17260.8 | 90668.8 | BF(88) | B(12) | Working Example |
| | 29 | 873 | 1015 | 17.3 | 81.2 | 17559.5 | 82418.0 | BF(92) | B(8) | Working Example |
| | 30 | 864 | 1005 | 16.2 | 75.6 | 16281.0 | 75978.0 | BF(95) | B(5) | Working Example |
| 4 | 31 | 866 | 1007 | 16.1 | 89.3 | 16212.7 | 89925.1 | BF(90) | B(10) | Working Example |
| | 32 | 882 | 1025 | 15.4 | 93.8 | 15785.0 | 96145.0 | BF(94) | B)6) | Working Example |
| | 33 | 597 | 853 | 13.1 | 68.3 | 11174.3 | 58259.9 | M(64) | F(18) + B(18) | Comparative Example |
| 5 | 34 | 857 | 997 | 15.1 | 88.6 | 15054.7 | 88334.2 | BF(95) | B(5) | Working Example |
| | 35 | 847 | 985 | 17.3 | 91.2 | 17040.5 | 89832.0 | BF(92) | B(8) | Working Example |
| | 36 | 853 | 992 | 15.2 | 78.4 | 15078.4 | 77772.8 | BF(90) | B(10) | Working Example |
| 6 | 37 | 949 | 1103 | 15.1 | 81.3 | 16655.3 | 89673.9 | BF(93) | B(7) | Working Example |
| | 38 | 992 | 1153 | 15.3 | 77.5 | 17640.9 | 89357.5 | BF(89) | B(11) | Working Example |
| | 39 | 940 | 1093 | 16.1 | 82.2 | 17597.3 | 89844.6 | BF(95) | B(5) | Working Example |
| | 40 | 968 | 1125 | 15.2 | 73.3 | 17100.0 | 82462.5 | BF(93) | 8(7) | Working Example |
| 7 | 41 | 926 | 1077 | 17.2 | 82.1 | 18524.4 | 88421.7 | BF(92) | B(8) | Working Example |
| | 42 | 913 | 1062 | 16.3 | 78.2 | 17310.6 | 83048.4 | BF(96) | B(4) | Working Example |
| 8 | 43 | 953 | 1108 | 15.4 | 75.8 | 17063.2 | 83986.4 | BF(95) | B(5) | Working Example |
| | 44 | 844 | 1205 | 11.1 | 88.1 | 13375.5 | 82060.5 | M(68) | F(18) + B(14) | Comparative Example |
| 9 | 45 | 925 | 1076 | 17.2 | 82.3 | 18507.2 | 88554.8 | BF(90) | B(10) | Working Example |
| | 46 | 977 | 1136 | 15.2 | 72.3 | 17267.2 | 82132.8 | BF(93) | B(7) | Working Example |
| | 47 | 790 | 988 | 10.1 | 55.2 | 9978.8 | 54537.6 | M(64) | F(15) + B(21) | Comparative Example |
| 10 | 48 | 944 | 1180 | 16.2 | 83.1 | 19116.0 | 98058.0 | BF(89) | B(11) | Working Example |
| | 49 | 878 | 1098 | 17.2 | 78.5 | 18885.6 | 86193.0 | BF(94) | B(6) | Working Example |
| | 50 | 828 | 1035 | 16.3 | 88.5 | 16870.5 | 91597.5 | BF(96) | B(4) | Working Example |
| 11 | 51 | 845 | 983 | 17.2 | 36.2 | 16907.6 | 35584.6 | P(65) | F(35) | Comparative Example |
| 12 | 52 | 710 | 825 | 16.4 | 68.1 | 13530.0 | 56182.5 | BF(90) | B(10) | Comparative Example |
| 13 | 53 | 933 | 1085 | 9.1 | 63.2 | 9873.5 | 68572.0 | BF(92) | B(8) | Comparative Example |
| 14 | 54 | 1004 | 1210 | 8.2 | 45.5 | 9922.0 | 55055.0 | BF(93) | B(7) | Comparative Example |
| 15 | 55 | 701 | 815 | 15.5 | 72.2 | 12632.5 | 58843.0 | BF(88) | B(12) | Comparative Example |
| | 56 | 742 | 863 | 13.2 | 69.2 | 11391.6 | 59719.6 | BF(91) | B(9) | Comparative Example |

Tables 4 to 6 suggest the following.

The steel samples 1 to 10 have the composition specified by the present invention, but the steel samples 11 to 15 (for comparison) do not have the composition specified by the present invention. The steel samples for comparison in Tables 5 and 6, which were prepared under the conditions Nos. 23, 24, 27, 33, 44, and 47, meet the requirements of the present invention but do not have the metallographic structure specified by the present invention because of inadequate manufacturing conditions.

It is apparent from these tables that the steel sheets made of the steel samples 11 to 15 which have the composition lacking the requirements of the present invention (that is, under the conditions 51 to 56) are poor in tensile strength (lower than 900 MPa) or poor in (TS×El) and/or (TS×λ). This holds true not only for the one which was produced under an inadequate condition (No. 51) and which does not have the metallographic structure specified by the present invention, but also for those which were produced under an adequate condition and have the metallographic structure specified by the present invention.

The steel sheets which were prepared from the steel samples 1 to 10, which have the composition meeting the requirements of the present invention, under any of inadequate conditions (Nos. 23, 24, 27, 33, 44, and 47) are apparently inferior in one of tensile strength, (TS×El), and (TS×λ) to those which were prepared under adequate manufacturing condition that leads to an adequate metallographic structure.

The invention claimed is:

1. A hot-rolled steel sheet comprising:

C: no less than 0.02% and no more than 0.15%,

Si: no less than 0.2% and no more than 2.0%,

Mn: no less than 0.5% and no more than 2.5%,

Al: no less than 0.02% and no more than 0.15%,

Cu: no less than 1.0% and no more than 3.0%,

Ni: no less than 0.5% and no more than 3.0%, and

Ti: no less than 0.03% and no more than 0.5%

(% means mass % for chemical components hereinafter), wherein the hot-rolled steel sheet comprises bainitic ferrite, ϵ-Cu precipitates dispersed in the bainitic ferrite, and optionally granular bainitic ferrite;

the hot-rolled steel sheet has a metallographic structure in longitudinal cross section such that the sum of bainitic ferrite and granular bainitic ferrite accounts for no less than 85% by area;

the hot-rolled steel sheet has a tensile strength (TS) greater than 900 MPa; and the hot-rolled steel sheet has a balance between strength and stretch flangeability [tensile strength (TS)×bore expanding ratio (λ): MPa·%] and a balance between strength and ductility [tensile strength (TS)×total elongation (El): MPa·%] such that these values satisfy the formula:

$$(TS\times\lambda: MPa\cdot\%)\geqq 146000-5.0\times(TS\times El: MPa\cdot\%).$$

2. The hot-rolled steel sheet as defined in claim 1, further comprising at least one species selected from the group consisting of:

Cr: no less than 0.05% and no more than 1.0%,

Mo: no less than 0.05% and no more than 1.0%,

V: no less than 0.05% and no more than 0.5%,

Nb: no less than 0.005% and no more than 0.5%,

B: no less than 0.0010% and mo more than 0.01%, and

Ca: no less than 0.0010% and no more than 0.01%.

3. The hot-rolled steel sheet as defined in claim 1, wherein the hot-rolled steel sheet comprises the granular bainitic ferrite.

4. The hot-rolled steel sheet as defined in claim 1, wherein the metallographic structure is such that the bainitic ferrite accounts for no less than 85% by area.

5. The hot-rolled steel sheet as defined in claim 1, wherein the ϵ-Cu precipitates measure about 5-20 nm.

6. The hot-rolled steel sheet as defined in claim 1, wherein the hot-rolled steel sheet comprises C: no less than 0.03% and no more than 0.10%.

7. The hot-rolled steel sheet as defined in claim 1, wherein the hot-rolled steel sheet comprises Si: no less than 0.5% and no more than 1.5%.

8. The hot-rolled steel sheet as defined in claim 1, wherein the hot-rolled steel sheet comprises Mn: no less than 0.7% and no more than 2.4%.

9. The hot-rolled steel sheet as defined in claim 1, wherein the hot-rolled steel sheet comprises Al: no less than 0.03% and no more than 0.1%.

10. The hot-rolled steel sheet as defined in claim 1, wherein the hot-rolled steel sheet comprises Cu: no less than 1.0% and no more than 2.5%.

11. The hot-rolled steel sheet as defined in claim 1, wherein the hot-rolled steel sheet comprises Ni: no less than 0.5% and no more than 2.5%.

12. The hot-rolled steel sheet as defined in claim 1, wherein the hot-rolled steel sheet comprises Ti: no less than 0.05% and no more than 0.5%.

13. The hot-rolled steel sheet as defined in claim 1, wherein the hot-rolled steel sheet has a metallographic structure in longitudinal cross section such that the sum of bainitic ferrite and granular bainitic ferrite accounts for no less than 90% by area.

14. The hot-rolled steel sheet as defined in claim 1, wherein the content of Cu is larger than 1.5% and no more than 3.0%.

15. The hot-rolled steel sheet as defined in claim 1, wherein the hot-rolled steel sheet is produced by a process comprising hot rolling a steel slab having the composition of the steel sheet wherein a finishing temperature of the hot rolling is in a range of from 910 to 950° C. to form the hot-rolled steel sheet, cooling the hot-rolled steel sheet at an average cooling rate of not less than 20° C./sec, winding the hot-rolled steel sheet at a temperature of from 400 to 600° C. and cooling the hot-rolled steel sheet from the winding temperature to 300° C. at an average cooling rate higher than 50° C./hr.

16. The hot-rolled steel sheet as defined in claim 15, wherein the winding temperature is higher than 500° C. and equal to or less than 600° C.

17. The hot-rolled steel sheet as defined in claim 1, wherein the sum of bainitic ferrite and granular bainitic ferrite is not less than 93% by area.

18. The hot-rolled steel sheet as defined in claim 1, wherein the tensile strength is 980 MPa or greater.

19. The hot-rolled steel sheet as defined in claim 15, wherein the winding temperature is higher than 500° C. and equal to or lower than 600° C.

* * * * *